US011206718B2

(12) United States Patent
Boeke et al.

(10) Patent No.: US 11,206,718 B2
(45) Date of Patent: Dec. 21, 2021

(54) LIGHTING DRIVER, LIGHTING CIRCUIT AND DRIVE METHOD

(71) Applicant: SIGNIFY HOLDING B.V., Eindhoven (NL)

(72) Inventors: Ulrich Boeke, Langerwehe (DE); Paul Theodorus Jacobus Boonen, Tegelen (NL)

(73) Assignee: SIGNIFY HOLDING B.V., Eindhoven (NL)

( * ) Notice: Subject to any disclaimer, the term of this patent is extended or adjusted under 35 U.S.C. 154(b) by 0 days.

(21) Appl. No.: 16/628,798

(22) PCT Filed: Jun. 29, 2018

(86) PCT No.: PCT/EP2018/067629

§ 371 (c)(1),
(2) Date: Jan. 6, 2020

(87) PCT Pub. No.: WO2019/007844

PCT Pub. Date: Jan. 10, 2019

(65) Prior Publication Data

US 2020/0205258 A1 Jun. 25, 2020

(30) Foreign Application Priority Data

Jul. 7, 2017 (EP) ..... 17180155

(51) Int. Cl.
*H05B 45/14* (2020.01)
*H05B 45/44* (2020.01)
*H05B 45/54* (2020.01)

(52) U.S. Cl.
CPC ..... *H05B 45/14* (2020.01); *H05B 45/44* (2020.01); *H05B 45/54* (2020.01)

(58) Field of Classification Search
None
See application file for complete search history.

(56) References Cited

U.S. PATENT DOCUMENTS

2008/0258647 A1 10/2008 Scianna
2012/0187863 A1* 7/2012 Nonaka ..... H05B 45/3725 315/291
2015/0028753 A1 1/2015 Kim
2017/0019967 A1 1/2017 Tischler et al.

FOREIGN PATENT DOCUMENTS

CN 1843061 A 10/2006
CN 101836505 A 9/2010
CN 102648664 A 8/2012

(Continued)

*Primary Examiner* — Amy Cohen Johnson
*Assistant Examiner* — Jianzi Chen
(74) *Attorney, Agent, or Firm* — Daniel J. Piotrowski

(57) ABSTRACT

A lighting driver is designed for driving an unknown lighting load and is based on a controlled DC driver, with a controlled output current. It is used in a first mode of operation to determine an operating current of the lighting load and in a second mode of operation to deliver a current to the lighting load in dependence the determined operating current, and optionally also in dependence on a dimming setting. In this way, the driver configures its output to the load based on an analysis of the current characteristics of the load, such as the maximum rated current.

13 Claims, 2 Drawing Sheets

(56) References Cited

FOREIGN PATENT DOCUMENTS

| | | | |
|---|---|---|---|
| CN | 103945600 | A | 7/2014 |
| CN | 104025711 | A | 9/2014 |
| EP | 2785144 | A2 | 10/2014 |
| WO | 2013072784 | A1 | 5/2013 |
| WO | 2013110027 | A1 | 7/2013 |

* cited by examiner

LIGHTING DRIVER, LIGHTING CIRCUIT AND DRIVE METHOD

CROSS-REFERENCE TO PRIOR APPLICATIONS

This application is the U.S. National Phase application under 35 U.S.C. § 371 of International Application No. PCT/EP2018/067629, filed on Jun. 29, 2018, which claims the benefit of European Patent Application No. 17180155.8, filed on Jul. 7, 2017. These applications are hereby incorporated by reference herein.

FIELD OF THE INVENTION

This invention relates to a lighting driver, and in particular which makes use of a controlled DC power source for providing dimming capability to LED lamps that are not dimmable by phase-cut dimmers.

BACKGROUND OF THE INVENTION

LEDs are driven by DC currents. Thus, an LED driver either has a DC power source or provides AC/DC conversion. In particular, driving an LED luminaire from a mains AC input requires conversion of the AC mains to a DC drive level suitable for driving the LED arrangement.

Different driver designs strive a different balance between cost and performance. A high cost driver typically makes use of a switched mode power supply, which provides AC/DC conversion as well as having feedback control of the output current and/or voltage of the driver.

US2012/0187863 and WO2013/072784 show example of LED drivers providing a DC current to LEDs. The drivers of these documents can be used with different LED loads and they both monitor current and voltage at the output of the drivers. For US2012/0187863, the driver can works according different setting and a progressive increase of the current is made at startup for determining how many LEDs are connected in such a way to define the setting to apply. For WO2013/072784, a current exploration is made for determining the corresponding maximum voltage in such a way to set a security threshold for overvoltage.

A lower cost driver for AC powered LED lamps avoids the need for the high frequency switching components of a switched mode power supply. Such a driver can thus be integrated into an LED lamp to provide an LED lamp which is a retrofit to an AC mains powered light socket.

However, such LED lamps require a high forward voltage of the order of the AC mains voltage amplitude and have many LEDs placed in series. This is for example the case for LED filament lamps, in which a long series of LEDs is provided to emulate the appearance of a traditional filament lamp. There may be a high number of LED chips in series and therefore with a high LED forward voltage.

FIG. 1 shows the electric circuit of a filament LED lamp 100 for AC mains supply, which thus incorporates an integrated driver. The driver receives an AC mains input 110. A fuse F1 is provided between the input 110 and a diode rectifier bridge BR1. An energy storage buffer capacitor C1 is provided across the output of the rectifier bridge, in parallel with the output load.

The output load comprises the LED arrangement, shown schematically as a number N of series LEDs LED 1 to LED N and a linear current regulating device D1 connected in series with the number of LEDs.

The current regulating device D1 for example comprises a two-terminal semiconductor component comprising a bipolar transistor, a diode and resistors. The component conducts a DC current with a low voltage drop as long as the DC current is below a reference value. If the DC current increases towards its reference value, this current is limited by its internal functions to remain below this reference current value. This is an example of an active current regulating device, but a passive device such as a resistor may be used.

The current regulating device thus controls the peak current flowing, with the capacitor C1 smoothing the rectified AC mains signal. The capacitor is charged when the instantaneous mains input is higher than an average (rms) value and the capacitor delivers charge to the LED arrangement when the instantaneous mains input is low.

A drawback of such an LED lamp is that it cannot easily be dimmed, for example it cannot be dimmed using a phase-cut dimmer due to high inrush currents in the energy storage buffer capacitor C1. The lamps of this type are thus generally only suited for non-dimmable applications.

It is known that such LED lamps can however be dimmed by supplying such LED lamps from a regulated DC power source instead of an AC mains voltage. However, in such a case, the range of the DC supply voltage that is supplied to the LED lamp must accurately match the LED string forward voltage in order to enable smooth dimming and to not exceed the power dissipation inside an LED lamp and hence affect its reliability. Filament LED lamps and related regulated DC power sources are, however, not standardized products so that it is not possible to provide a single DC power source design which is suitable for a large range of LED lamp types.

For example, a regulated DC power source does not know the electric characteristics of the filament lamp such as the number of lamps and the rated power level of an installation. Some parameters such as the LED forward voltage are also product-dependent and temperature-dependent and also not known to the regulated DC power source. As a result, the regulated DC power source will typically supply an installation of such LED lamps at a nominal operation voltage, which is higher than would be needed. This will increase power losses and the temperature at the internal linear current regulating device. As a further consequence, the lighting installation is not optimized due to excessive power losses at the linear current regulating device inside the lamp.

There is therefore a need for a regulated DC power source which is able to provide efficient dimming of a range of different possible LED lamp arrangements, in particular LED lamps which are designed as a retrofit AC lamp.

SUMMARY OF THE INVENTION

According to examples in accordance with an aspect of the invention, there is provided a lighting driver for driving an LED lighting load, comprising:

- a controlled DC power source;
- a current sensor for sensing a current flowing through the lighting load; and
- a controller connected to the current sensor for controlling an output current of the controlled DC power source, wherein the controller is adapted to implement:
  - a first, test mode of operation for detecting at least one operating current of the lighting load; and
  - a second, operating mode of operation for delivering a current to the LED lighting load in dependence on the determined operating current.

This driver provides current regulation to perform dimming of an LED lighting load. To enable the driver to deliver a suitable current, the driver performs a test mode (the first mode) for detecting an operating current. This operating current is for example a rated or other maximum current to be delivered to the load. The operating current can then be scaled to implement a dimming function.

The operating current can thus be determined for an unknown LED lighting load. Using this parameter, the dimmer function can operate with a maximum dimming range such as 2% to 100%, while giving low power losses and low thermal stress of the lighting load.

The lighting load for example comprises a network of retrofit AC LED lamps. These retrofit lamps for example comprise a current limiting device in series with the lighting load. This current limiting function in particular enables the operating current to be detected, since it creates a recognizable current-voltage profile.

The driver comprises a voltage detector, and the controller is adapted, in the first mode, to:

deliver a sequence of drive currents to the lighting load;

measure an output voltage for each drive current and thereby obtain a voltage current relationship; and determine an operating current range from the voltage current relationship for which a minimum and a maximum operating current are determined from currents at which the output voltage shows a threshold behavior.

In this way, a maximum operating current can be determined to be the current at the level for which the current remains (or starts to remain) substantially constant with increasing voltage. This is the rated current which is much more independent of voltage than lower current levels. In other words, the differential resistance of an unknown electric load strongly increases at the rated current of the electric load. As mentioned above, it for example results from the use of a current limiting component in the lighting load circuit.

The controller is for example adapted, in the first mode, to:

determine a function of the incremental output voltage with respect to an increase in drive current.

There is an elbow in the voltage current function, and by detecting a large jump in voltage for a small increment in current, this elbow location is identified. When the ratio of incremental voltage increase to load current increase is above a threshold, the maximum operating current has been reached. The minimum operating current may be calculated as a fixed proportion of the maximum operating current, or it may be determined independently from the voltage current relationship.

The controller may be adapted, in the second mode, to:

deliver an output operating current between the minimum operating current and the maximum operating current as a function of a dimming level.

In this way the current is regulated between a minimum value and a maximum value, wherein the maximum and minimum values are obtained from the preceding detecting step.

The controller may be adapted to perform the first mode:

each time power is newly supplied to the driver; and/or in response to user input; and/or in response to a timer signal.

The first (test) mode needs to take place each time there may have been a change in the load characteristics. Such a change is only likely to take place with the driver turned off, but a periodic detection step may also take place, for example to enable changes in the lighting load characteristics over time (e.g. ageing) also to be taken into account.

The controller may be adapted to perform the first mode in response to detection of a variation in the lighting load, in particular the power consumption of the lighting load. A reduction may be detected based on a voltage drop at the converter output or particular characteristics of a voltage rate of change. Similarly, a voltage increase may be detected. These variations may arise from short circuit or open circuit failure modes.

The controlled DC power source preferably has a maximum DC output voltage which functions as a protection function. Thus, although current regulation is employed for driving the lighting load, overvoltage protection is also provided.

The controller may be adapted to identify from the output voltage of the controlled DC power source an overload or load short circuit condition. This overload or short circuit condition may be detected based on a voltage decrease across the load or a DC output voltage below a programmed target range. This overload may be detected in either of the two modes of operation. An error message such as an error code may be provided when detecting an overload or short circuit.

The controlled DC power source may comprise a DC/DC converter. It may further comprise an AC/DC converter for receiving an AC mains input and generating internally a DC power input for the DC/DC converter. Thus, the driver may receive an AC mains input and generate the DC power input internally. Without the AC/DC converter, the driver may instead receive a DC power input as an external input.

The invention also provides a lighting circuit comprising:

a LED arrangement; and a driver as defined above for driving the LED arrangement.

The LED arrangement for example comprises one or more retrofit AC LED lamps.

Examples in accordance with another aspect of the invention provide a method for driving a lighting load, comprising:

performing a first, test mode of operation to determine at least one operating current of the lighting load; and performing a second, operating mode of operation to deliver a current to the lighting load in dependence on the determined operating current, wherein the current is delivered by operating a controlled DC power source using feedback from a current sensor for sensing a current flowing through the lighting load.

The method comprises, in the first mode:

delivering a sequence of drive currents to the lighting load;

measuring an output voltage for each drive current thereby obtain a voltage current relationship; and determining a range of operating currents from the voltage current relationship for which a minimum and a maximum operating current are determined from currents at which the output voltage shows a threshold behavior.

In the first mode, the method may comprise:

determining a function of the incremental output voltage with respect to an increase in drive current.

The first mode may be performed:

each time power is newly supplied to the driver; and/or in response to user input; and/or in response to a timer signal; and/or in response to detection of a variation in the lighting load.

BRIEF DESCRIPTION OF THE DRAWINGS

Examples of the invention will now be described in detail with reference to the accompanying drawings, in which.

DETAILED DESCRIPTION OF THE EMBODIMENTS

The invention provides a lighting driver for driving an unknown lighting load based on a controlled DC driver, with a controlled output current. It is used in a first, test mode of operation to detect at least one operating current of the lighting load and in a second, operating, mode of operation to deliver a current to the lighting load in dependence on the detected operating current and preferably also in dependence on a dimming setting. In this way, the driver configures its output to the load based on an analysis of the current characteristics of the load, such as the maximum rated current.

Figure 1:
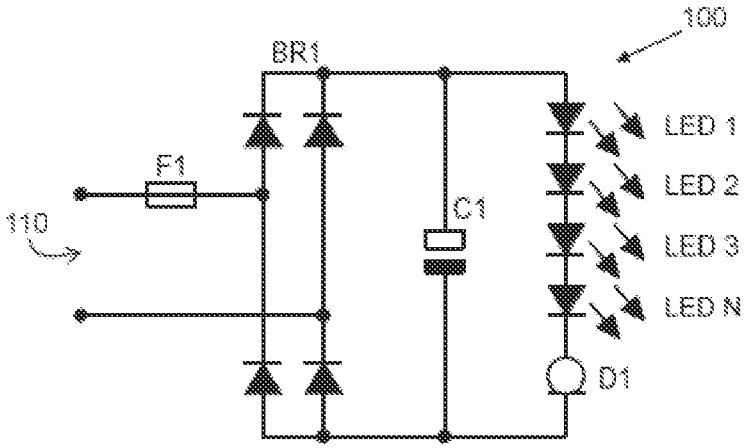
FIG. 1 Prior Art
FIG. 1 shows a known LED lamp which includes an integrated driver.
Figure 2:
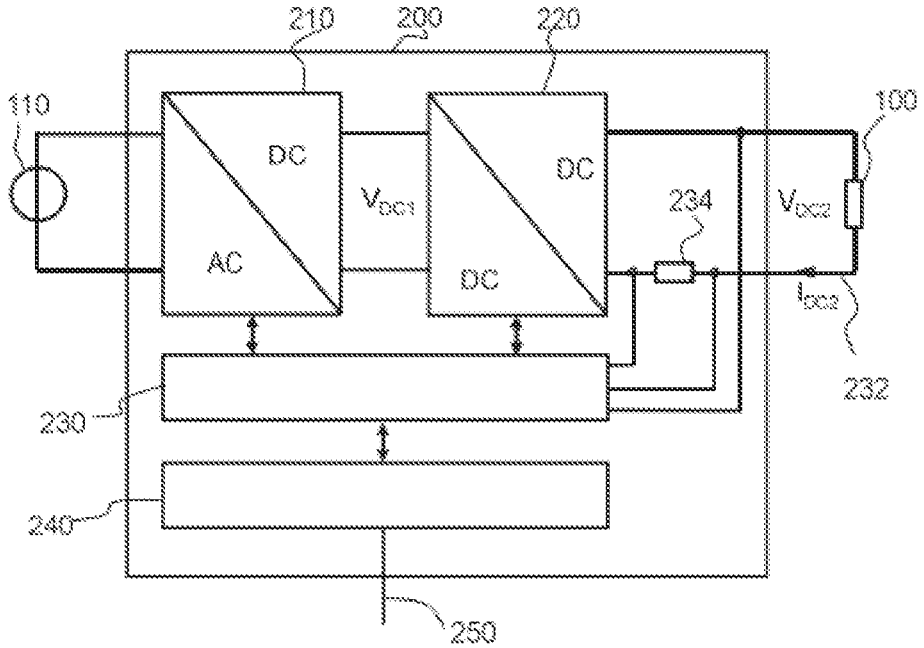
FIG. 2 shows a lighting driver in accordance with the invention which includes a controlled DC power source.

FIG. 2 shows an example of a lighting driver 200 in accordance with an example of the invention. The lighting driver functions as a regulated DC power source, in particular having a regulated output current, and it is able to implement a dimming function for lighting systems which make use of (usually non-dimmable) retrofit AC LED lamps, such as shown in FIG. 1.

The example shown receives a mains AC input 110 and is adapted to generate a regulated DC output current 232. The DC output voltage is not directly controlled but results from the current driven through the lighting load. The output voltage is however limited, in particular when the regulated output current is not consumed by a load.

This lighting driver supplies LED lamps or LED luminaires which are shown schematically as load 100. They are of the type shown in FIG. 1 and hence comprise a buffer capacitor, and DC current limiting components (such as diodes and/or resistors) or DC current regulators to limit the maximum DC current, for example to limit the current in each LED string assembly.

The LED lamps or luminaires typically also include integrated rectifiers since they are designed for retrofit AC operation. However, for operation based on a DC input, these simply perform a pass through function. The operation of the driver however only requires the lighting load to have a recognizable current (e.g. a rated current or other operating current) which is representative of a maximum driving current.

The lighting driver could receive an external DC input. However, in the example shown, the driver 200 comprises a first AC/DC converter 210 that converts the AC mains voltage 110 to a first controlled DC bus voltage $V_{DC1}$. This DC bus voltage supplies a DC/DC converter 220 that generates a controlled DC output current 232 for supply to the lighting load 100.

Together, the converters 210, 230 define a two-stage AC/DC converter structure. Any suitable AC/DC converter may be used for providing a regulated current. In the example shown, the AC/DC converter transforms the AC voltage into a DC voltage, which may be subject to ripple. The DC/DC converter transforms the DC voltage into a DC regulated current which is strongly regulated to a desired current level.

Thus, in an example which receives an external DC voltage, the controlled DC power source is simply a DC/DC converter with a regulated output current. In other examples, the controlled DC power source may be considered to be the combination of an AC/DC converter and a DC/DC converter or other AC/DC converter architecture.

In the example shown with separate AC/DC and DC/DC converters, the AC/DC converter is for example a switched mode converter with power factor correction. It delivers a regulated output voltage $V_{DC1}$.

Similarly, the DC/DC converter is also for example a switched mode converter, such as a buck converter, forward converter or a resonant load type of power converter.

The retrofit lamps are thus low cost components, and the drivers enable the use of these low cost retrofit lamps, which are usually non-dimmable, with a dimmable lighting driver.

A controller 230 includes means to regulate the DC output voltage of the AC/DC converter 210 and to regulate the DC output current 232 of the DC/DC converter 220. Note that external control of the AC/DC converter output voltage is not essential, in that it may have a single set output bus voltage $V_{DC1}$ and thus does not require external control. In the example of FIG. 2, the bus voltage is controllable as well as the output current of the DC/DC converter 220. The control of the output current of the DC/DC converter is decoupled from the voltage control of the AC/DC converter.

The driver includes current feedback as part of the current control loop. The current feedback signal is generated across a current sense resistor 234 in series with the load 100. The voltage across the current sense resistor is monitored by the controller 230. The feedback voltage is compared with a reference signal for example using a comparator to implement control of the AC/DC converter and/or the DC/DC converter. The current sensor 234 is used for stabilizing the current to the required value. Other kinds of current driver can replace the driver 200 for providing a stabilized current.

The controller also includes a voltage sensor for sensing the output voltage delivered by the controlled DC power source.

The reference current signal to be used by the current control loop can be programmed within certain limits by means of a communications circuit 240. This is used to implement dimming functionality. The communications circuit has a communication interface 250 to receive an analogue or a digital signal. The digital signal can be a Digital Assisted Lighting Interface (DALI) signal or an Ethernet or ZigBee or Bluetooth or NFC signal. It functions as the user interface to the driver, over which dimming commands may be provided.

The controlled DC current in the load 100 generates the DC output voltage $V_{DC2}$ of the DC/DC converter 220 as a function of the lighting load impedance. This DC output voltage must, however, be within the large signal limits of the DC/DC converter e.g. between 100 V and 300 V.

The driver has two modes of operation.

A first, test, mode of operation (load detection mode) measures an operating current (e.g. a rated current) of the lighting load, which for example comprises an unknown number of LED lamps. This load detection preferably takes place at least every time the supply voltage of the driver and lighting system is turned on.

The operating current detection is explained with reference to FIG. 3. It shows a plot of lighting load voltage (V) versus lighting load current (mA).

The plot relates to a lighting load of 96 LEDs connected in series in combination with an integrated driver as shown in FIG. 1.

This plot is derived by the controller 230 by increasing the output current delivered by the DC/DC converter 220 gradually during the first mode of operation. For each current value, the output voltage is measured, and the ratio of the load voltage increase to the load current increase (hence dV/dI) also called the differential resistance is measured. This is shown in FIG. 4 which plots the ratio (dV/dI in V/mA, i.e. kΩ) versus current (mA).

Figure 3:
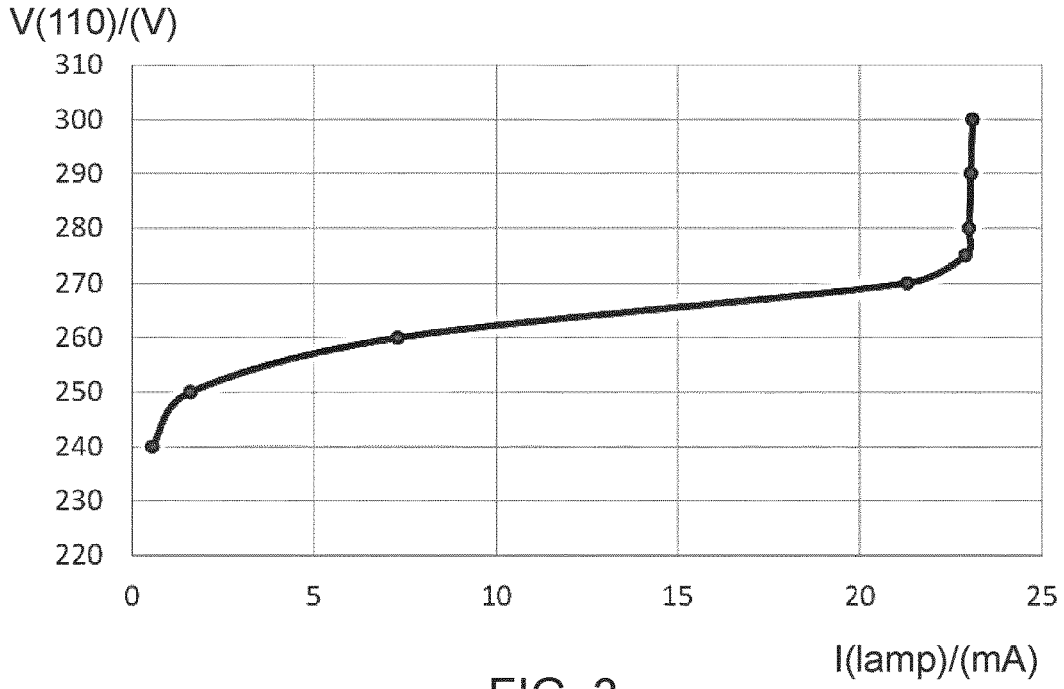
FIG. 3 is a first plot to explain an operating current detection method.

In FIG. 3, a maximum current between 22 mA and 23 mA is reached. There is a first elbow in the voltage vs. current function at this position, so that the maximum current is detectable because there is a threshold behavior. There is also in this example a second elbow at the minimum current setting, above which the voltage vs. current function is substantially linear, up to the first elbow. A minimum operating current may thus be determined as the current at this second elbow. However, the minimum operating current may instead be defined as a simple ratio of the maximum operating current.

The voltage and current values will scale depending on the series and parallel arrangement of LEDs. For example, a greater number of series LEDs will increase the voltage, whereas LEDs in parallel will increase the voltage.

Figure 4:
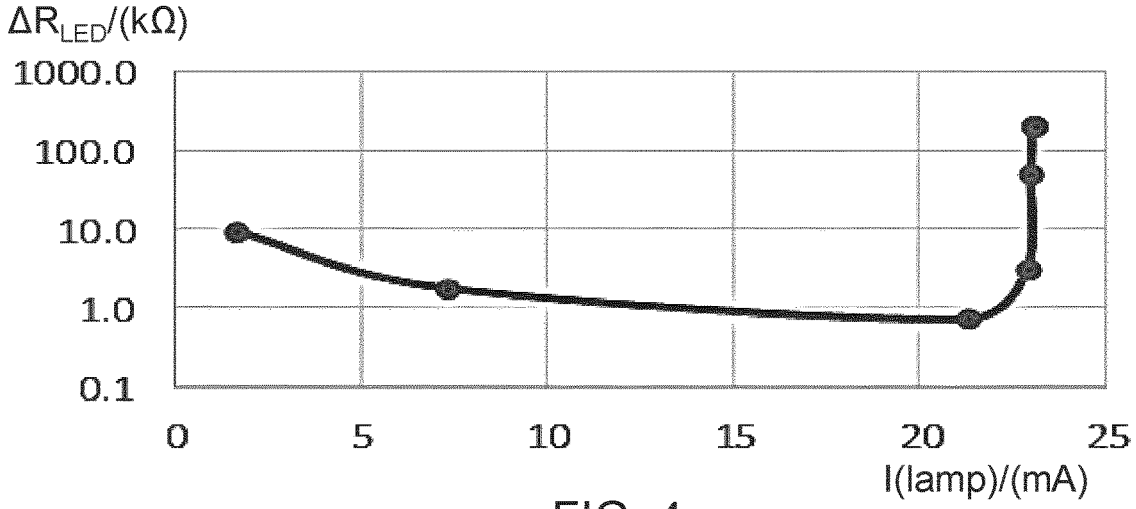
FIG. 4 is a second plot to explain an operating current detection method.

In FIG. 4, the differential LED lamp input resistance (shown as $\Delta R_{LED}$) is plotted, which is the gradient dV/dI. The value is in the approximate range 0.8 kΩ to 10 kΩ in the normal dimming range. The gradient dV/dI increases to a value in the range 50 kΩ to 200 kΩ when the supplied LED lamp is operated with its nominal (rated) current.

Note that these values relate only to a specific and single LED lamp. The resistance values will be multiplied by 1/N if a number N of such lamps is operated in parallel.

For the first three plotted points (1.6 mA, 7.5 mA and 21.3 mA) in FIG. 4, the current limiting function is not visible. The next plotted plot at a current of 22.9 mA shows the start of the current limiting effect. The differential input resistance has increased from around 0.8 kΩ to around 3 kΩ and in response this point is defined as a nominal operating point, in particular the maximum current is determined to be 22.9 mA. The lowest current value may for example be defined as the current at which the differential input resistance first drops below 10 kΩ.

A current operating range can thus be defined from 1.6 mA to 22.9 mA.

Above 22.9 mA, linear current limiting devices in the LED lamps increase their impedance. The first significant increase of the differential LED lamp voltage in this way marks the rated current of the unknown LED lamp installation. This load current value is stored in the lighting driver as a reference operating current, which may be taken to be the 100% load current, i.e. the rated current. The LED driver output current range is then between 0 mA or a non-zero minimum value and this 100% load current.

As explained above, the minimum current may be also be determined from the plots shown, so that the full operating current range is determined based on threshold behavior, or else the minimum current may be a scaled value of the maximum rated current. The minimum current may even be set to zero.

The load detection mode is repeated at least at every turn on of the lighting system since the number of supplied LED lamps per driver unit could have changed when the lighting system has been switched off.

A second mode of operation is the normal operating mode. Users of the driver can adjust a dimming level by using the interface 250 to determine the relative LED lamp current and with that indirectly the relative power level. The maximum LED lamp current level is the operating current value measured during the first mode of operation.

The interface to adjust the dimming level can be a rotating knob or two push bottoms to increase or decrease the dimming level or it can be an analogue or digital electrical signal to transmit the dimming signal from an external interface such as a remote control unit or a computer e.g. a smartphone.

The controlled DC power source has two protection functions in the normal operation mode when it supplies a number of LED lamps with a regulated DC current. These protection functions ensure safe operation of the system when the number of power consuming lamps changes e.g. if the number is reduced by a broken LED lamp. The first protection mode limits the absolute maximum output voltage of the controlled DC power source to a safe value of e.g. 300 V DC when using LED lamps designed for 230 V AC RMS mains voltage (that has a 325 V AC peak voltage). The second protection function monitors the DC output voltage of the controlled DC power source. When one LED lamp breaks the remaining LED lamps will operate each with a higher DC current since the driver regulates a constant total DC current for all supplied lamps. An increased DC current per lamp increase the DC output voltage of the driver that can be measured.

A positive change in voltage or rate of change of voltage in normal operation is interpreted as disturbance that triggers the lighting driver to switch from normal operation mode back to the first, load detection, mode in order to measure a new rated current of the lighting system.

In the case of a short circuit in an LED lamp or the lighting system, the DC output voltage of the controlled DC power source will drop in normal operation (giving a negative rate of change of voltage) or it may fall below a target operating range of e.g. 240 V to 280 V DC that would also occur during load detection mode.

Both behaviors are monitored by a third protection function of the controlled DC power source that will turn off its output current and report an error code.

The first mode may be instigated by a user for example by pressing a push button or by sending a control signal to an interface of the lighting driver. A programmable timing sequence may also be used that repeats the first mode of operation after programmed time intervals.

The invention enables an AC system of non-dimmable retrofit LED lamps to be transformed into a dimmable DC system using the same retrofit LED lamps. The system is transformed by simply powering the AC lamps with a DC current driver which has a learning step for measuring the characteristics of the AC lamp in such a way to set the maximum and minimum current that can be used for dimming the lamp.

Figure 5:
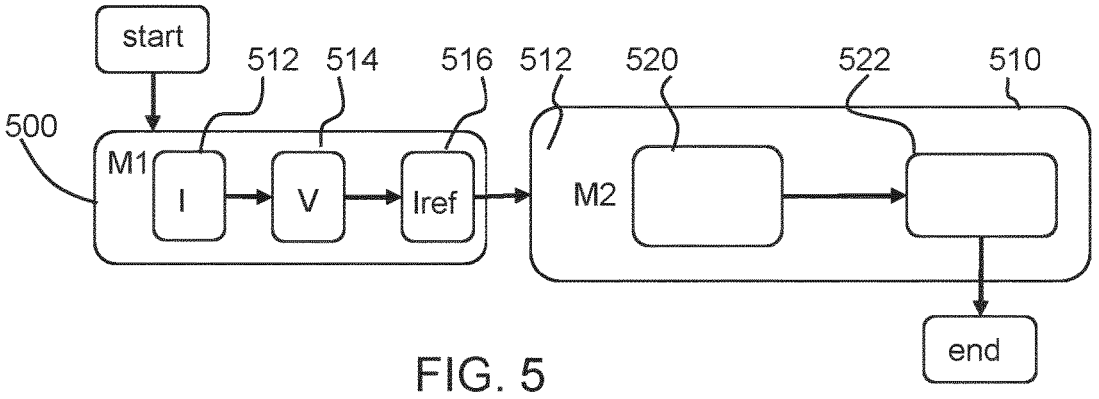
FIG. 5 shows a lighting driving method.

FIG. 5 shows a method for driving a lighting load, comprising:

in step 500, performing a first mode of operation to detect at least one operating current of the lighting load; and in step 510, performing a second mode of operation to deliver a current to the lighting load in dependence on a dimming setting and on the detected operating current (or currents).

In the first mode 500, the method may involve:

step 512 of delivering a sequence of drive currents to the lighting load;

step 514 of determining an output voltage for each drive current thereby obtain a voltage current relationship; and step 516 of determining the operating current or currents from the voltage current relationship.

The second mode 510 of the method comprises delivering a controlled DC power source to the load, taking account of a dimming setting and the determined operating current or currents.

This may comprise AC/DC conversion 520 and DC/DC conversion 522 to provide a regulated output current.

The invention is of interest for dimming of LED lamps and luminaires with a DC dimmer in consumer and professional spaces.

The lighting driver may receive a mains AC input. However, there may be a DC power source, for example a local power source to a large commercial building, and the lighting drivers then receive a DC input, thus avoiding the need for local AC/DC conversion by the controlled DC power source.

In the example above, the test mode obtains a single operating current, such as a maximum drive current, from which the minimum drive current may be obtained. The test mode may instead derive two (or more) operating currents, such as a minimum current and a maximum current.

Other variations to the disclosed embodiments can be understood and effected by those skilled in the art in practicing the claimed invention, from a study of the drawings, the disclosure, and the appended claims. In the claims, the word "comprising" does not exclude other elements or steps, and the indefinite article "a" or "an" does not exclude a plurality. The mere fact that certain measures are recited in mutually different dependent claims does not indicate that a combination of these measures cannot be used to advantage. Any reference signs in the claims should not be construed as limiting the scope.

The invention claimed is:

1. A lighting driver for driving a lighting load, comprising:

a controlled DC power source;

a current sensor for sensing a current flowing through the lighting load;

a voltage sensor for sensing an output voltage delivered by the controlled DC power source; and a controller connected to the current sensor for controlling an output current of the controlled DC power source, wherein the controller is adapted to implement:

a first, test mode of operation for determining at least one operating current of the lighting load; and a second, operating mode of operation for delivering a current to the lighting load in dependence on the determined operating current wherein the controller is adapted, in the first mode, to:

deliver a sequence of drive currents to the lighting load;

measure the output voltage for each drive current and thereby obtain a voltage current relationship; and determine an operating current range from the voltage current relationship for which a minimum and a maximum operating current are determined from the sequence of drive currents at which the output voltage shows a threshold behavior.

2. A lighting driver as claimed in claim 1, wherein the controller is adapted, in the first mode, to:

determine a function of an incremental output voltage with respect to an increase in drive current.

3. A lighting driver as claimed in claim 1, wherein the controller is adapted, in the second mode, to deliver an output operating current between the minimum operating current and the maximum operating current as a function of a dimming level.

4. A lighting driver as claimed in claim 1, wherein the controller is adapted to perform the first mode:

each time power is newly supplied to the driver; and/or in response to user input; and/or in response to a timer signal.

5. A lighting driver as claimed in claim 4, wherein the controller is adapted to detect the variation in the lighting load from a monitoring of the output voltage of the controlled DC power source.

6. A lighting driver as claimed in claim 1, wherein the controlled DC power source has a maximum DC output voltage which functions as a protection function.

7. A lighting driver as claimed in claim 1, wherein the controller is adapted to identify from the output voltage of the controlled DC power source an overload or load short circuit condition.

8. A lighting driver as claimed in claim 1, comprising an AC/DC converter for receiving an AC mains input, said AC/DC converter comprising the controlled DC power source.

9. A lighting circuit comprising:

an LED arrangement; and a lighting driver as claimed in claim 1 for driving the LED arrangement.

10. A lighting circuit as claimed in claim 9, wherein the LED arrangement comprises one or more retrofit AC LED lamps.

11. A method for driving a lighting load, comprising:

performing a first, test mode of operation to determine at least one operating current of the lighting load; and performing a second, operating mode of operation to deliver a current to the lighting load in dependence on the determined operating current, wherein the current is delivered by operating a controlled DC power source and monitored by a current sensor for sensing a current flowing through the lighting load wherein the first mode comprises:

delivering a sequence of drive currents to the lighting load;

measuring an output voltage for each drive current thereby obtain a voltage current relationship; and determining a range of operating currents from the voltage current relationship for which a minimum and a maximum operating current are determined from the sequence of drive currents at which the output voltage shows a threshold behavior.

12. A method as claimed in claim 11, comprising, in the first mode:

determining a function of the incremental output voltage with respect to an increase in drive current.

13. A method as claimed in claim 11, comprising performing the first mode:

each time power is newly supplied to the driver; and/or in response to user input; and/or in response to a timer signal.

* * * * *